US007980005B1

(12) United States Patent
Young

(10) Patent No.: US 7,980,005 B1
(45) Date of Patent: Jul. 19, 2011

(54) TOE JAMMERS

(76) Inventor: Joyce C. Young, Kansas City, MO (US)

( * ) Notice: Subject to any disclaimer, the term of this patent is extended or adjusted under 35 U.S.C. 154(b) by 722 days.

(21) Appl. No.: 12/035,627

(22) Filed: Feb. 22, 2008

(51) Int. Cl.
*A43B 3/12* (2006.01)
*A43B 7/26* (2006.01)

(52) U.S. Cl. ..... 36/11.5; 36/94

(58) Field of Classification Search ..... 36/11.5, 36/136, 94
See application file for complete search history.

(56) References Cited

U.S. PATENT DOCUMENTS 2,506,308 A * 5/1950 Maynier ..... 602/30
2,511,101 A * 6/1950 Clarke ..... 602/30
2,751,693 A * 6/1956 Baker ..... 36/94
2,808,662 A * 10/1957 Webb ..... 36/11.5
3,928,927 A * 12/1975 Brown et al. ..... 36/11.5
4,832,644 A * 5/1989 Roberts ..... 441/64
4,877,018 A * 10/1989 Ikebe et al. ..... 602/30
5,497,789 A 3/1996 Zook
D399,568 S 10/1998 VanCleave et al.
2002/0121030 A1 9/2002 Coleman
2003/0230312 A1 12/2003 Dumitrascu
2005/0198870 A1 9/2005 Berger et al.
2006/0210751 A1 9/2006 Cunningham
2008/0301977 A1* 12/2008 Roberts et al. ..... 36/94
2010/0024247 A1* 2/2010 Feeney et al. ..... 36/94

* cited by examiner

*Primary Examiner* — Marie Patterson

(57) ABSTRACT

The invention is an improved cushion for use with the web joint of a thong-type sandal. The invention is a cylinder comprising an inner layer consisting of a viscoelastic gel, and an outer layer of memory foam. The exterior of the outer layer may be outfitted with a design. The interior of the cylinder has a layer of adhesive. A split is provided for installation of the invention.

4 Claims, 2 Drawing Sheets

TOE JAMMERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of thong inserts.

B. Discussion of the Prior Art

The Coleman Patent Application Publication (U.S. Pub. No. 2002/0121030) discloses a cylindrically shaped foam-like cushion for attachment around the straps of footwear having straps. However, the cushion of the Coleman publication does not disclose a gel layer.

The Berger et al. Patent Application Publication (U.S. Pub. No. 2005/0198870) discloses a device providing protection of the web space between the big toe and adjacent toe while wearing thong-type sandals. However, the device of the Berger publication does not disclose the use of a gel layer.

The Cunningham Patent Application Publication (U.S. Pub. No. 2006/0210751) discloses a kit containing various adhesive pads for attachment to the straps of sandals. However, the pads of the Cunningham publication do not disclose the use of a gel layer.

The Zook Patent (U.S. Pat. No. 5,497,789) discloses a medicated padding for toes. However, the padding of the Zook Patent does not integrate both an inner layer of viscoelastic gel and an outer layer of memory foam for use about the web space between the big toe and the adjacent toe while wearing thong-type sandals.

The Dumitrascu Patent Application Publication (U.S. Pub. No. 2003/0230312) discloses a skin-adhering device for protecting feet from damage while wearing sandals. However, the device of the Dumitrascu publication does not include a cylindrically shaped pad with a layer of gel and a layer of memory foam for use about the web region of a thong-type sandal in direct contact with the big toe and the adjacent toe.

The VanCleave et al. Patent (U.S. Pat. No. Des. 399,568) illustrates a design for a toe and finger wrap, which does not depict being used on the web portion of a thong-style sandal in between the big toe and adjacent toe.

BRIEF SUMMARY OF THE INVENTION

The invention is an improved cushion for use with the web joint of a thong-type sandal. The invention is a cylinder comprising an inner layer consisting of a viscoelastic gel, and an outer layer of memory foam. The exterior of the outer layer may be outfitted with a design. The interior of the cylinder has a layer of adhesive. A split is provided for installation of the invention.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
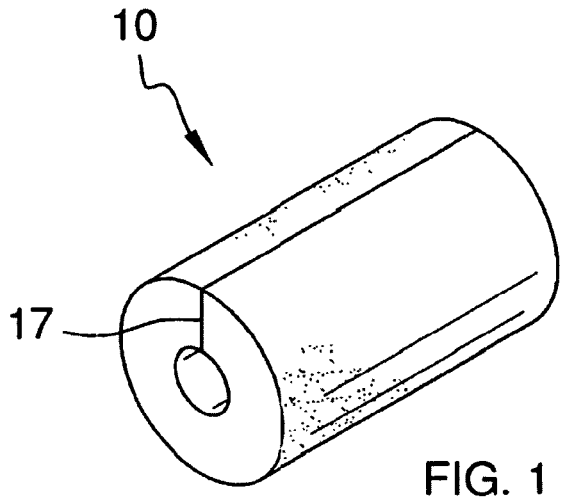
FIG. 1 illustrates an isometric view of the invention by itself.
Figure 2:
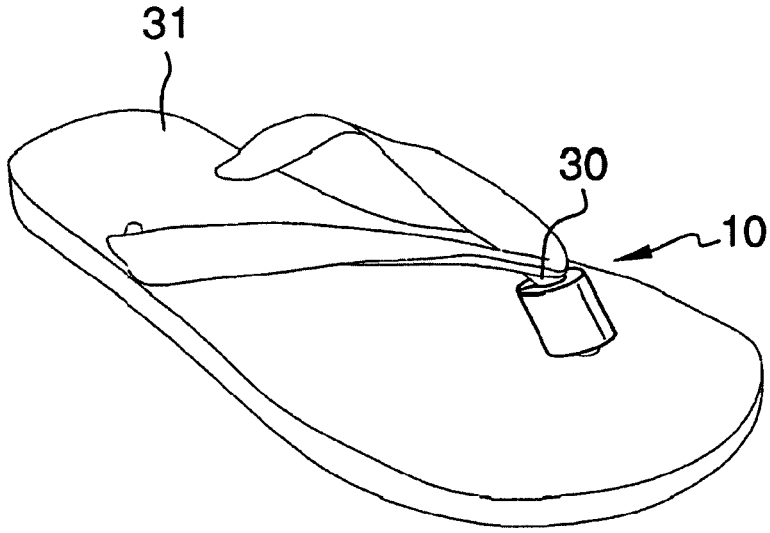
FIG. 2 illustrates an isometric view of the invention of the invention in use.
Figure 3:
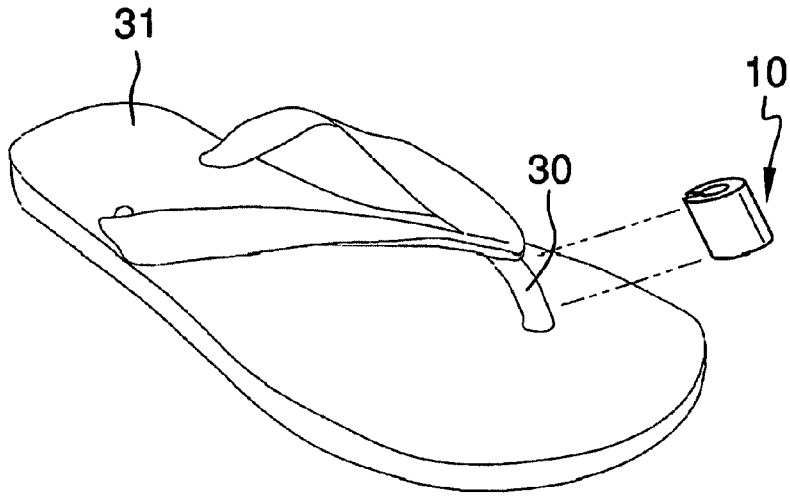
FIG. 3 illustrates an exploded view of the invention and a thong-type sandal.
Figure 4:
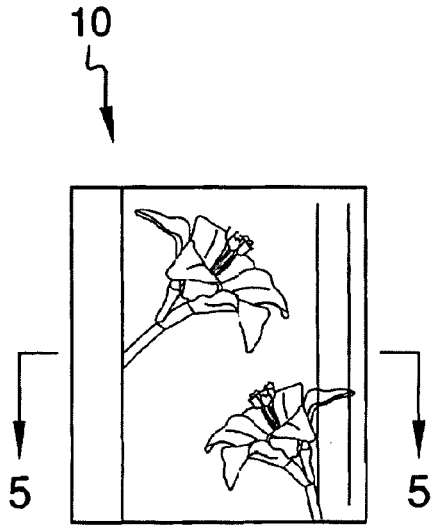
FIG. 4 illustrates a side view of the invention.
Figure 5:
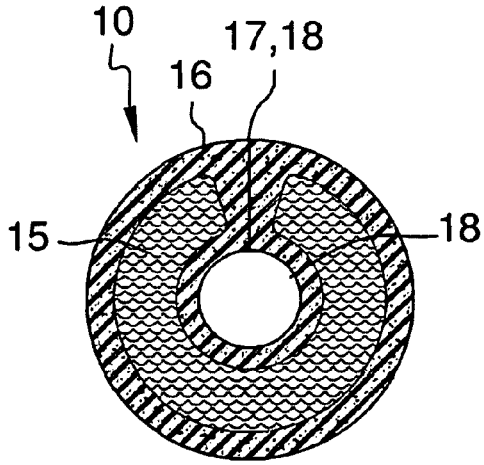
FIG. 5 illustrates a cross-sectional view of the invention along line 5-5 in FIG. 4.

Detailed reference will now be made to the briefcase embodiment of the present invention, examples of which are illustrated in FIGS. 1-5. An improved cylindrical cushion 10 (hereinafter invention) includes an inner layer 15, an outer layer 16, and a split 17.

The inner surface of the invention 10 and along both inner surfaces of the split is adorned with an adhesive layer 18. The adhesive layer 18 is covered by an adhesive preserving strip of paper (not shown) that is removed prior to installation of the invention 10. Upon removal of the adhesive preserving strip, the adhesive layer 18 provides a means of securing the split 17 together, and of securing the inner surface of the cylinder to a web 30 of a thong-style sandal 31.

The inner layer 15 is made of a material comprising a viscoelastic gel. The outer layer 16 is made of a material comprising memory foam. It shall be noted that the material of the inner layer 15 and the outer layer 16 may be exchanged.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

While the embodiments of the invention have been disclosed, certain modifications may be made by those skilled in the art to modify the invention without departing from the spirit of the invention.

The inventor claims:

1. A cylindrical cushion for attachment to the web of thong footwear comprising:

(a) an interior layer;

wherein said interior layer being of cylindrical shape, thus having an inner bore for receiving the web of thong footwear;

wherein the surface of the inner bore is adorned with a layer of adhesive for use in securing the cylindrical cushion to the web of thong footwear;

wherein the interior layer is made of a material comprising viscoelastic gel;

(b) an exterior layer;

wherein the exterior layer is made of a material comprising viscoelastic gel;

(c) a split;

wherein the split gasses through both the interior layer and exterior layer; and wherein the split creates inner surfaces of both the interior layer and the exterior layer.

2. The cylindrical cushion as described in claim 1 wherein the inner surfaces of the split is adorned with a layer of adhesive for use in securing the inner surfaces of the split together.

3. A cylindrical cushion for attachment to the web of thong footwear comprising:

(a) an interior layer;

wherein said interior layer being of cylindrical shape, thus having an inner bore for receiving the web of thong footwear;

wherein the interior layer is made of a material comprising viscoelastic gel;

(b) an exterior layer;

wherein the exterior layer is made of a material comprising viscoelastic gel;

(c) a split;

wherein the split passes through both the interior layer and exterior layer;

wherein the inner surfaces of the split, is adorned with a layer of adhesive for use in securing the inner surfaces of the split together; and wherein the split creates inner surfaces of both the interior layer and the exterior layer.

4. The cylindrical cushion as described in claim 3 wherein the surface of the inner bore is adorned with a layer of adhesive for use in securing the cylindrical cushion to the web of thong footwear.

* * * * *